United States Patent [19]

Cairns

[11] 4,445,690

[45] May 1, 1984

[54] GAME APPARATUS

[76] Inventor: Frank D. Cairns, 3635 Artesia Blvd. #230, Torrance, Calif. 90504

[21] Appl. No.: 350,626

[22] Filed: Feb. 22, 1982

[51] Int. Cl.[3] ..... A63F 7/00

[52] U.S. Cl. ..... 273/118 R

[58] Field of Search ..... 273/118 R, 118 A, 118 D, 273/123 R, 1 A

[56] References Cited

U.S. PATENT DOCUMENTS

| | | | |
|---|---|---|---|
| 970,257 | 9/1910 | McDonald et al. | 273/123 R |
| 2,636,740 | 4/1953 | McNeal | 273/118 R |
| 2,943,858 | 7/1960 | Slater | 273/118 R |
| 3,871,650 | 3/1975 | Casey | 273/123 R X |
| 4,185,819 | 1/1980 | Hartley | 273/1 A |

OTHER PUBLICATIONS

Miles Kimball Co. Catalog 12-1966, p. 94, Shuffle-Scotch Reversible Mat.

*Primary Examiner*—Paul E. Shapiro
*Attorney, Agent, or Firm*—Roger A. Marrs

[57] ABSTRACT

A game apparatus includes a circular mat providing a smooth, non-friction surface for rollably supporting marbles and a border mat about the edge of the circular mat having cooperative edge regions overlapping each other so that the edge of the circular mat defines a circular marble collection area with a raised barrier carried on the border mat. The circular mat and border are coaxially disposed with respect to each other. Obstacles reside beneath the mats to provide sloping barriers for affecting travel of marbles across the mat surfaces.

5 Claims, 4 Drawing Figures

GAME APPARATUS

BACKGROUND OF THE INVENTION

1. Field of the Invention

This invention relates to recreational or game apparatus and more particularly, to a novel game having a sheet or layer of non-frictional material upon which the players of the game shoot or roll game pieces across the surface thereof and which includes selected barriers at desired locations about the sheet or layer serving as obstacles to the roll of the game pieces.

2. Brief Description of the Prior Art

In the past, most games or recreational games generally provide for a plurality of players to move individual tokens or symbols about the playing surface of a game board. Generally, the game board is located on a table and the participants either sit in chairs or lean over the table in order to take an active part in the game. Such activity is vicarious and does not require the physical presence of the players on the game board surface itself since this is considered to be awkward and cumbersome due to the sheer physical size and weight of the participants. Therefore, games using tokens and symbols representing individual players are commonplace.

However, on certain occasions such as in the play of marbles or the like, active physical participation in the game or event is entertaining, enjoyable and skillful. A typical game of this catagorie usually involves players who lay out a playing field and commencing at the peripheral edge thereof, shoot balls or marbles across the surface thereof at selected targets which may be other marbles belonging to players of the game or which may be a target such as a dish, cup or the like. During the course of play, a participant is sometimes required to kneel on the playing surface itself and shoot the marble in this position and location. As long as the game is played on the ground such as a dirt field, no problem is encountered with support of the player or any adverse playing conditions are encountered which might enhibit or restrict the shoot of the marble.

Difficulties and problems have been encountered when endeavoring to play the conventional game of marbles indoors due to the fact that bare wood floors are hard on the knees of the players and using a carpeted area as the playing surface greatly restricts the speed and direction of the shooting marbles. Also, when playing indoors, space is greatly restricted and the participants cannot move freely about the playing area in order to retrieve marbles which have left the playing field after a shooting procedure has taken place.

Therefore, a longstanding need has existed to provide a novel game apparatus which will permit the indoor play of marbles according to the conventional rules which will not only permit the players to kneel and step on the playing surface but which will not retard or distort the direction of a marble shoot during the course of play. Collection means for stopping and holding marbles after leaving the playing area is greatly desired and such means should not interfere with the kneeling or walking of the participants.

SUMMARY OF THE INVENTION

Accordingly, the above problems and difficulties are obviated by the present invention which provides a novel game apparatus including a sheet or layer of material adapted to rotatably support in a non-frictional manner, a plurality of rolling game pieces such as marbles and which will also support the weight and maneuvering of players as they kneel or walk about the playing surface. The game apparatus includes a circular mat having an extensive smooth, non-frictional surface for rollably supporting a plurality of game pieces such as marbles. A boarder mat is provided about the outer peripheral edge of the circular mat having co-operative edge marginal regions overlapping each other so as to provide an outer peripheral edge of the circular mat that defines a circular marble collection area in combination with a raised cushion barrier carried on the furthermost perimeter of the boarder mat. The barrier is in spaced apart relationship with respect to the circular mat peripheral edge and is pliable so that the barrier may readily be depressed upon the kneeling or walking upon by a player. Selected ring and straight members are deployed beneath the mats to raise a portion thereof providing sloping obstacles or barriers for affecting travel of the marble playing pieces across the mats surfaces.

Therefore, it is among the primary objects of the present invention to provide a novel game apparatus which includes a playing track or surface over which actual players can walk or kneel and wherein the surface of the course or path is non-friction while being resilient.

Still another object of the present invention is to provide a novel game apparatus having a playing surface over which players may step and kneel and while includes a resilient composition in the material thereof for cushioning such travel and which will adequately recover to a straight and smooth surface for accomodating travel of rollable playing pieces, such as marbles, during the course of play.

Yet another object of the present invention is to provide a novel game apparatus which is enjoyable for the players and wherein the players can take active participation in the activity by walking and kneeling on the playing surface without the use of representative tokens or symbols.

Still a further object of the present invention is to provide a novel game apparatus wherein the conventional game of marbles can be played indoors that includes a circular playing surface upon which the participants can walk or kneel and which includes barrier means at selected locations about the playing area for effecting the collection of spent marbles after being shot and for increasing the complexity of the game according to the rules thereof.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
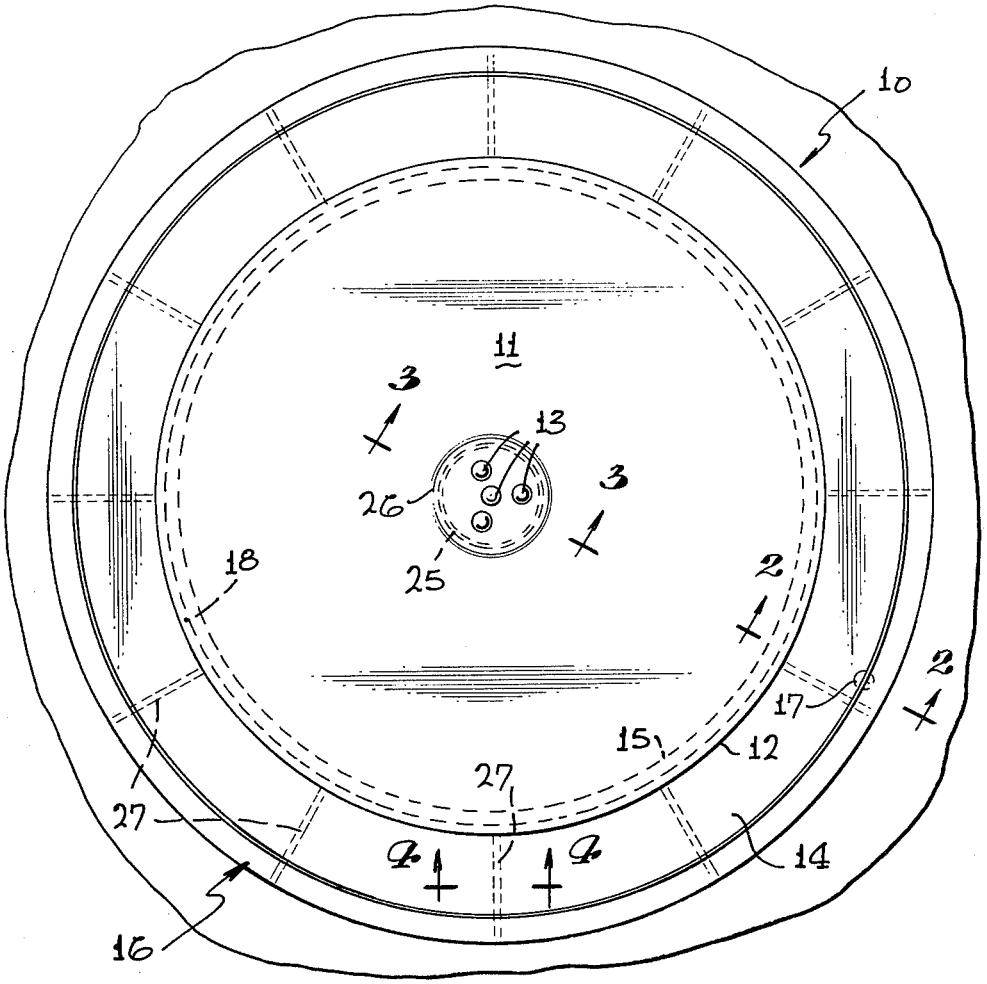
FIG. 1 is a top plan view of the novel game apparatus incorporating the present invention.

Referring to FIG. 1, the novel game apparatus of the present invention is shown in the general direction of arrow 10 which includes a central circular mat 11 having a peripheral terminating edge 12. The mat 11 is composed of a resilient material of plastic or plastic-like composition that permits players to walk kneel on the surface thereof in a comfortable fashion while at the same time having recoverable charastics so that any depression or distortion of the playing surface will return to the original flat and smooth surface position. Therefore, it is to be understood that the composition of the mat 11 is such that the material includes the characteristics of having a built-in memory so that when the knee of a player has caused a depression therein, recovery of the material to a smooth and flat surface will take place when the player's knees have been removed. Also, the pliability of the material is important so that the mat 11 may be readily rolled into a storage condition when the game is not being played. Since an objective of the invention is to provide indoor games, storage of all the components in a closet or under a bed is important.

A plurality of playing pieces such as marbles as indicated by numeral 13 are employed during the course of play. The marbles are shot or rolled across the surface of the mat 11 and as is the usual play, one marble is directed to strike another with the intent of causing the struck marble to fly or roll out of the central playing area into either a collection target area or some other target location. The present game apparatus includes a collection means taking the form of an annular or circular ring mat 14 which includes an inner edge marginal region 15 disposed under the overlapping peripheral edge marginal region of the mat 11. Also, the ring mat 14 includes a barrier or game piece stop means identified by numeral 16. The barrier takes the form of an outwardly projecting lip so that it projects a short distance above the playing surface so that it will interfere with and stop the forward progress of the marble. For example, marble 17 is illustrated as having been stopped by the outwardly projecting lip of the barrier 16.

Figure 2:
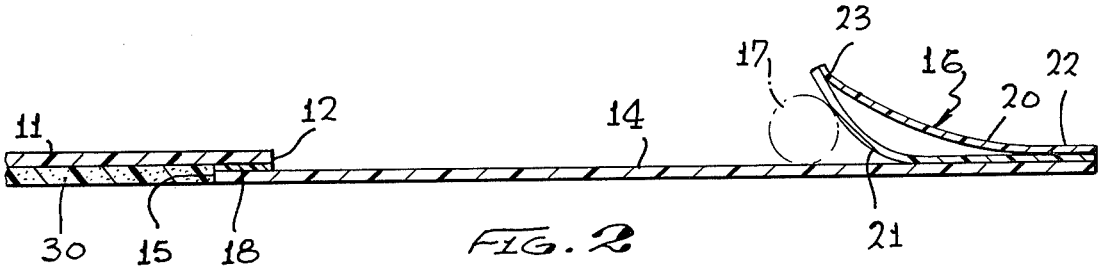
FIG. 2 is a transverse cross sectional view of the game apparatus shown in FIG. 1 as taken in the direction of arrows 2—2 illustrating the collection means thereof.

Referring now in detail to FIG. 2, it can be seen that a marble collection area is defined between the opposing edge 12 of mat 11 and the outwardly projecting lip of barrier 16. In order to prevent playing pieces such as marble 17 from rolling back onto the mat 11, the edge marginal region adjacent to edge 12 of mat 11 is raised slightly by a spacer 18 which separates the edge marginal region of the mat 11 from the underlying ring mat 14. Therefore, the spacer 18 adds to the thickness of the mat 11 at edge 12 to provide a barrier preventing return of a marble onto the mat 11 after it has rebounded from the lip barrier 16. Also, it is to be noticed that the barrier 16 includes an annular sheet of material 20 which is of a given length and that the lip further includes a second sheet of material 21 which is of a longer length than the sheet 20. When the adjacent edges of the sheets of material are sewn together, a upwardly curved lip is produced as illustrated. Preferably, attachment of the sheets 20 and 21 are by sewing techniques and the combination is then sewed to the outer edge marginal region of the ring mat 14 at a location indicated by numeral 22. The inner edge of the barrier is sewn at location 23. Other forms of attachment may be employed such as adhesives or the like.

An important feature of the lip barrier 16 being formed in this matter resides in the fact that the barrier may be stepped on, sat upon or kneeled on by players without causing injury or harm to the person. In other words, the material will give to the weight of the player and when the weight has been removed, the lip will return to the upwardly projecting position as shown in the drawing. Therefore, it can be seen that the barrier means is deformable but that is has a memory which will return to the upwardly projecting position after the distortion or deformation.

Figure 3:
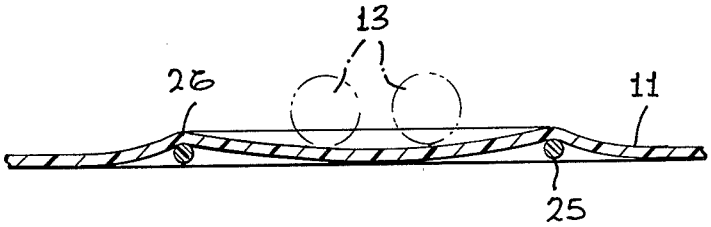
FIG. 3 is a cross sectional view of the game apparatus as taken in the direction of arrows 3—3 of FIG. 1 illustrating a ring barrier defining an obstacle in the form of a dish.

Referring now in detail to FIG. 3, added amusement and skill is added to the game by providing an obstacle taking the form of a ring 25 which is placed beneath the central area of mat 11. This causes the mat to rise in a cup shape and the rise is indicated by numeral 26. The marble, such as marble 13 must be propelled by the player along the top surface of mat 11 and over the rise 26 with sufficient power to enter the depression within the center of the ring 25. However, should too much power be imparted to the marble, the marble will ride through the dish or depression and over the other side back onto the mat 11.

Figure 4:
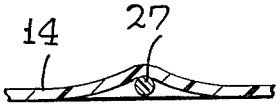
FIG. 4 is a cross sectional view taken in the direction of arrows 4—4 of FIG. 1 illustrating a bar or rod type barrier serving as an obstacle in the collection area.

As shown in FIG. 4, another obstacle may take the form of a bar or rod member 27 that may be placed under the ring mat 14. It can be seen that the rod barrier 27 may be placed in a radial fashion in spaced apart relationship as shown in FIG. 1. Such deployment of rods 27 provides areas around the mat 11 for collecting of the marbles after they have left the mat 11. If the rods 27 were not in place, a marble with sufficient speed may travel in a circle around the mat 11 on the collection mat 14. At times this may be desirable; however, when it is undesirable then rod 27 may be employed. This provides a plurality of catch basins or depressions around the periphery of mat 11 and makes it easier for the players to collect the marbles.

In view of the foregoing, it can be seen that the game apparatus of the present invention provides for an indoor game of marbles employing mats which may be rolled up for storage purposes and be unrolled when it is desired to play a game. Since the composition of material includes a memory characteristic, the mat 11 will rapidly return to a flat deployment so that a flat, smooth surface is presented for rolling the marbles thereon. The lip barrier 16 will upwardly project after unrolling because of the memory characteristic of the material and the particular construction as defined by the sheets 20 and 21. Furthermore, the memory characteristic is aided substantially by the temperature in the room so that with ambient temperature, the material will assume the desired positions and characteristics. The players may readily walk and kneel on the material without injury to themselves and a variety of game options and procedures may be employed using the ring barrier 25 and the rod or bar obstacles 27 when layed beneath either one of the mats 11 or 14.

If desired, a circular base 30 is provided for supporting the the mat 11. The thickness of the base 30 compliments the thickness of the combined spacer 18 and the circular mat 14. The characteristic of the plastic composition is such that a marble is held in place even if the undersurface is not level.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A game apparatus comprising a circular mat of plastic-like composition having a playing surface terminating in a circular peripheral edge;

a ring mat surrounding said circular mat having an outer barrier raised above said playing surface;

said barrier comprises a first and a second sheet of resilient material having opposite edges attached together;

said first sheet is of shorter width than the width of said second sheet so that an upwardly curved lip projects from said ring mat;

a plurality of rollable playing pieces adapted to be propelled across said playing surface;

a playing piece collection area defined on said ring mat between said circular mat peripheral edge and said outer barrier;

said circular mat and said ring mat of a composition characterized as being deformable and resilient and adapted to return to a substantially flat shape after deformation; and said circular mat includes an edge marginal region adjacent said peripheral edge lapped over an inner portion of said ring mat; and an annular spacer carried on said ring mat beneath said circular edge marginal region.

2. The invention as defined in claim 1 including:

obstacle means disposed immediately under a selected one of said mats deformating said mat so as to provide a raised obstacle or a depression in said playing surface.

3. The invention as defined in claim 2 wherein:

said obstacle means includes a ring.

4. The invention as defined in claim 3 wherein:

said obstacle means includes a rod.

5. The invention as defined in claim 4 wherein:

said mats are adapted to be rolled and unrolled into a storage condition and a playing condition.

* * * * *